US006830143B2

(12) United States Patent
King

(10) Patent No.: US 6,830,143 B2
(45) Date of Patent: Dec. 14, 2004

(54) CALIBRATION OF CURRENCY VALIDATORS

(75) Inventor: Katharine Louise King, Hampshire (GB)

(73) Assignee: Mars Incorporated, McLean, VA (US)

( * ) Notice: Subject to any disclaimer, the term of this patent is extended or adjusted under 35 U.S.C. 154(b) by 146 days.

(21) Appl. No.: 10/328,340

(22) Filed: Dec. 23, 2002

(65) Prior Publication Data

US 2003/0121755 A1 Jul. 3, 2003

(30) Foreign Application Priority Data

Dec. 28, 2001 (EP) ..... 01310939

(51) Int. Cl.[7] ..... G07D 7/00
(52) U.S. Cl. ..... 194/302
(58) Field of Search ..... 194/302, 229, 194/353, 217; 73/1.01, 163; 702/33, 81, 82, 179

(56) References Cited

U.S. PATENT DOCUMENTS 5,971,128 A 10/1999 Billington et al. ..... 194/317
5,992,602 A * 11/1999 Zwieg et al. ..... 194/317
6,311,820 B1 * 11/2001 Hallas Bell et al. ..... 194/317

FOREIGN PATENT DOCUMENTS

| | | | | |
|---|---|---|---|---|
| GB | 2 251 111 A | | 6/1992 | ..... G07D/5/00 |
| GB | 2.251.111 A | * | 6/1992 | ..... G07D/5/00 |
| GB | 2 293 039 A | | 3/1996 | ..... G07F/3/02 |
| WO | WO 99/49423 | | 3/1999 | ..... G07F/3/02 |

* cited by examiner

*Primary Examiner*—Donald P. Walsh
*Assistant Examiner*—Mark J. Beauchaine
(74) *Attorney, Agent, or Firm*—Fish & Richardson P.C.

(57) ABSTRACT

Articles belonging to known calibration classes are fed, in any sequence, to a currency acceptor in order to derive measurements which are used for calibration purposes. The calibration articles are classified, preferably by normalising a number of the measurements using a further measurement as a normalisation factor, and then calculating a Mahalanobis distance using the normalised measurements. The measurements are prevented from being used for calibration purposes if an integrity check suggests that they are unreliable.

20 Claims, 5 Drawing Sheets

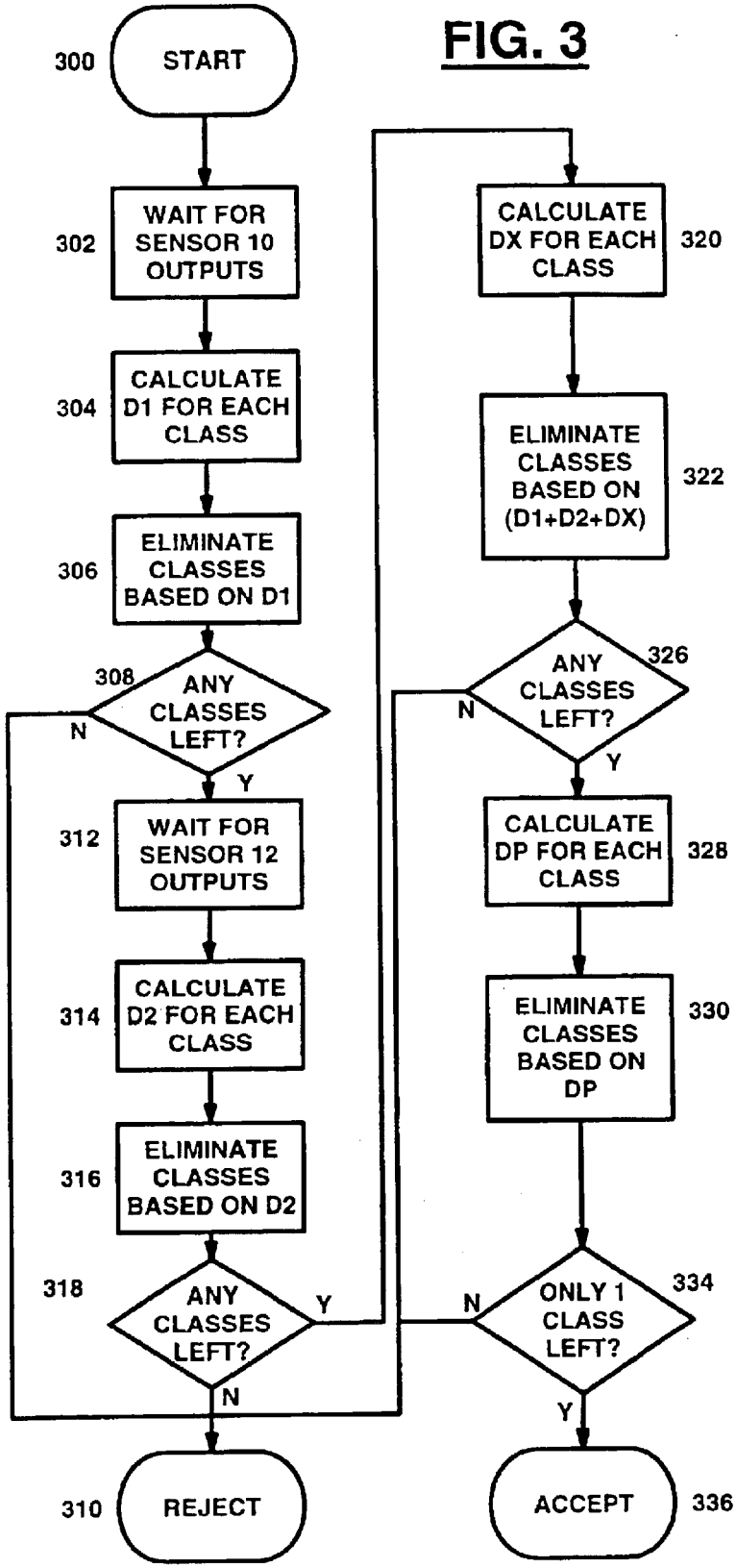
FIG. 3
300
START
302
WAIT FOR SENSOR 10 OUTPUTS
304
CALCULATE D1 FOR EACH CLASS
306
ELIMINATE CLASSES BASED ON D1
308
ANY CLASSES LEFT?
N
Y
312
WAIT FOR SENSOR 12 OUTPUTS
314
CALCULATE D2 FOR EACH CLASS
316
ELIMINATE CLASSES BASED ON D2
318
ANY CLASSES LEFT?
Y
N
310
REJECT
320
CALCULATE DX FOR EACH CLASS
322
ELIMINATE CLASSES BASED ON (D1+D2+DX)
326
ANY CLASSES LEFT?
N
Y
328
CALCULATE DP FOR EACH CLASS
330
ELIMINATE CLASSES BASED ON DP
334
ONLY 1 CLASS LEFT?
N
Y
336
ACCEPT

CALIBRATION OF CURRENCY VALIDATORS

BACKGROUND OF THE INVENTION

This invention relates to the calibration of currency validators. It is applicable both to banknote validators and coin validators, and to the initial calibration of the validators in the factory of a manufacturer and to the re-calibration of validators in the field.

It is well known that currency acceptors, or validators, require calibration to take into account small differences in the sensor responses to currency articles. One common technique for calibration (see for example GB-A-1 452 740) involves taking measurements of currency articles, storing data (for example upper and lower limits) associated with these measurements, and subsequently testing articles by determining whether measurements of the articles are consistent with stored data.

This procedure permits very reliable operation, but the calibration procedure can be very time consuming. Each apparatus has to measure a statistically significant number of articles of the denominations, or classes, which the apparatus is subsequently operable to recognise. Techniques for reducing the amount of time and effort required during calibration have been proposed. See for example GB-A-2 199 978.

It is also known for validators to have an automatic re-calibration function, some times known as "self-tuning", whereby acceptance criteria are regularly updated on the basis of measurements performed during testing (see for example EP-A-0 155 126, GB-A-2 059 129 and U.S. Pat. No. 4,951,799). This technique is useful in that it can take account of changes in the characteristics of the individual apparatus.

Generally speaking, calibration techniques often require the validator to be placed in a special calibration mode, and involve controlled conditions in which the measured articles are of known classes. Accordingly, the measurements can be treated as reliable, although it is still necessary to take into account possible "flyers", i.e. articles which, because of unusual circumstances, fail to be measured in the appropriate conditions—see for example EP-A-0781439.

Self-tuning techniques, on the other hand, take advantage of the fact that the apparatus is already calibrated. Accordingly, the apparatus can use measurements of articles tested and found to belong to a certain class for the purposes of re-calibrating, which generally takes the form of adjusting the acceptance criteria for the particular class. However, a problem with this technique is that the classification may not be accurate, and therefore it is possible for re-calibration to result in a deterioration in reliability unless special measures are taken to prevent this.

SUMMARY OF THE INVENTION

It would be desirable to provide a technique for calibrating acceptors which can be carried out more quickly and more easily than the prior art techniques.

Aspects of the present invention are set out in the accompanying claims.

According to a further aspect of the invention, an uncalibrated mechanism is used to classify articles measured by the apparatus, using generic classification criteria which are common to this and other apparatuses. Calibration of the apparatus is then performed using both the measurements and the classifications.

This technique differs from conventional calibration techniques in that the apparatus is itself used to classify the articles measured in the calibration process. In normal calibration techniques, each inserted article was of a predetermined, known class, and the uncalibrated mechanism was not relied upon to classify the article. It has, however, been found that even an uncalibrated mechanism, when supplied with articles known to belong to a certain group of classes, can reliably allocate each article to the correct class. Accordingly, the articles used in calibration can be fed in any sequence, thus simplifying the calibration procedure. This technique also differs from self-tuning techniques, in which the classification is performed by a calibrated apparatus, and in which received articles are not known to belong to specific classes.

Preferably, each article is recognised by using data derived from correlations between different article measurements in a population of the respective class. Preferably, the articles are classified by normalising at least some of their measurements, using one or more other measurements as normalisation factors, so as to reduce acceptor-to-acceptor variations in the classification criteria.

According to a still further aspect of the invention, the measurements of articles derived during a calibration procedure are subject to an integrity check to determine whether they should be used for calibration purposes. Different types of integrity checks may be used. The first type of integrity check involves comparing different measurements of an article with each other. Preferably, the comparison operation involves determining whether the relationship between those measurements matches a correlation which has been found in populations of articles of the relevant class. If the relationships do not match this correlation, then the measurements of the article are deemed inappropriate for use in calibration.

Another integrity check involves comparing a first type of measurement of an article with corresponding measurements of other articles. This comparison stage also preferably involves determining whether the relationships between the measurements matches a statistical correlation found by evaluating populations of the relevant calibration classes. A similar operation can be performed on the other measurements of the respective articles. This integrity check is preferably repeated, each time using a different article for normalisation purposes. This allows articles with unrepresentative measurements to be distinguished from properly-measured articles.

The various aspects of the invention are particularly useful for enabling calibration to be carried out in a very quick and simple manner involving measurements of only a relatively small number of articles, and preferably only a single article of each of a relatively small number of known classes. This would normally result in a high risk of calibration being carried out incorrectly, but the integrity checks can rapidly detect whether any of the measured articles is unrepresentative, for example if it is a "flyer", in which case the measurements from that article can be disregarded.

In a preferred embodiment, the calibration procedure involves measuring, in any sequence, a small number of articles belonging to respective different classes, for example one of each class, and providing an indication if any integrity check is failed, so that at least one of the articles can be re-measured. Preferably, the indication is capable of identifying an article which caused the integrity check failure so that if desired only this class of article needs to be re-measured.

The invention is applicable to various types of calibration procedures. For example, the article measurements can be used to set ranges used as acceptance criteria for recognising other articles belonging to the same classes as those used during calibration, similar to the procedure in GB-A-1 452 740. Alternatively, or additionally, the measurements can be used to derive acceptance criteria for different classes, similar to the techniques used in GB-A-2 199 978. A further possibility is to use the calibration data to adjust measurements made of articles before these measurements are checked against acceptance criteria.

BRIEF DESCRIPTION OF THE DRAWINGS

An embodiment of the present invention will now be described by way of example with reference to the accompanying drawings, in which:

FIG. 3 is a flow chart showing an acceptance-determining operation of the validator;

There will first be described a coin validator which is calibrated using the techniques of the present invention.

DETAILED DESCRIPTION

Figure 1:
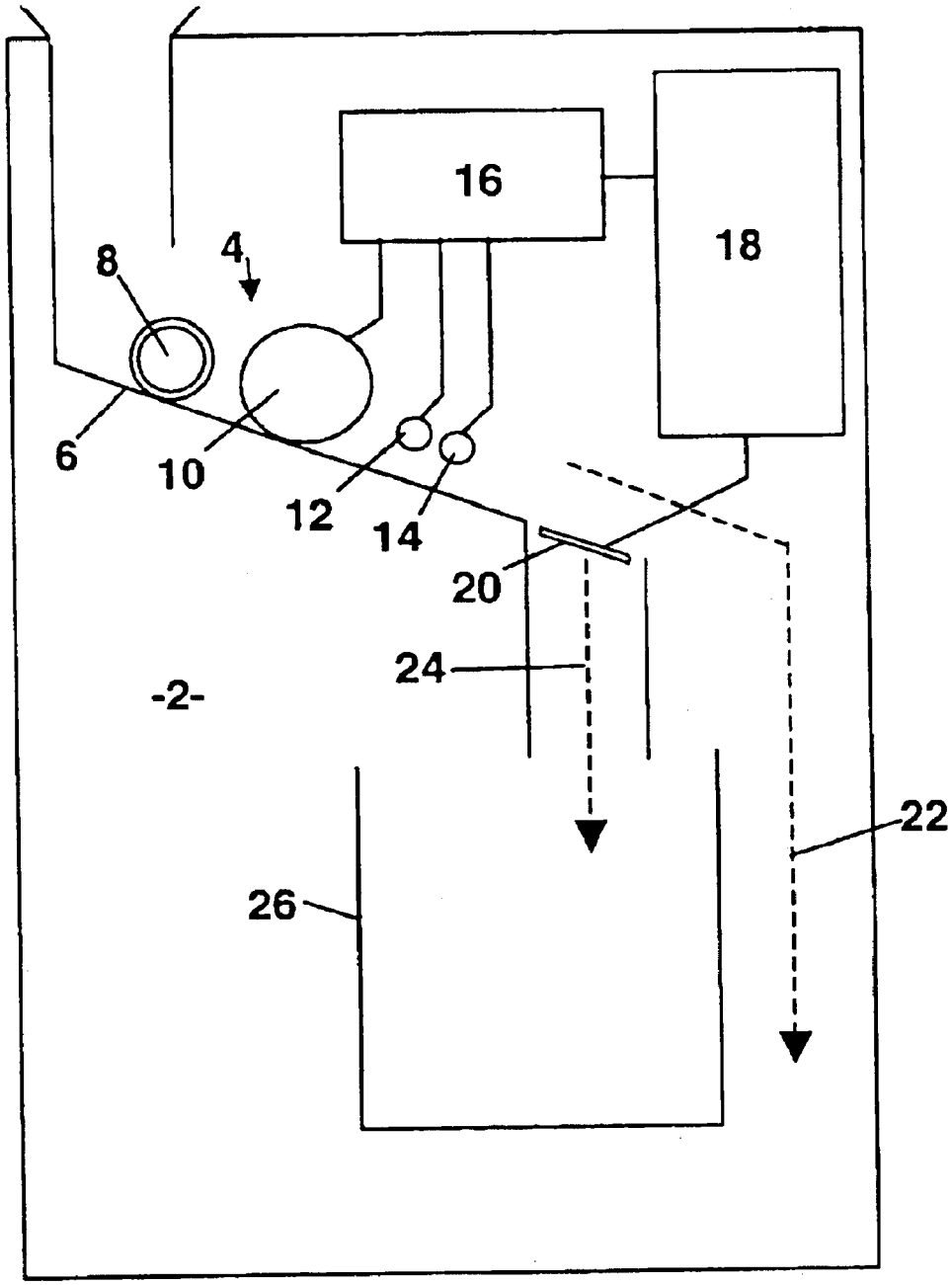
FIG. 1 is a schematic diagram of a coin validator in accordance with the invention.

Referring to FIG. 1, the coin validator 2 includes a test section 4 which incorporates a ramp 6 down which coins, such as that shown at 8, are arranged to roll. As the coin moves down the ramp 6, it passes in succession three sensors, 10, 12 and 14. The outputs of the sensors are delivered to an interface circuit 16 to produce digital values which are read by a processor 18. Processor 18 determines whether the coin is valid, and if so the denomination of the coin. In response to this determination, an accept/reject gate 20 is either operated to allow the coin to be accepted, or left in its initial state so that the coin moves to a reject path 22. If accepted, the coin travels by an accept path 24 to a coin storage region 26. Various routing gates may be provided in the storage region 26 to allow different denominations of coins to be stored separately.

In the illustrated embodiment, each of the sensors comprises a pair of electromagnetic coils located one on each side of the coin path so that the coin travels therebetween. Each coil is driven by a self-oscillating circuit. As the coin passes the coil, both the frequency and the amplitude of the oscillator change. The physical structures and the frequency of operation of the sensors 10, 12 and 14 are so arranged that the sensor outputs are predominantly indicative of respective different properties of the coin (although the sensor outputs are to some extent influenced by other coin properties).

In the illustrated embodiment, the sensor 10 is operated at 60 KHz. The shift in the frequency of the sensor as the coin moves past is indicative of coin diameter, and the shift in amplitude is indicative of the material around the outer part of the coin (which may differ from the material at the inner part, or core, if the coin is a bicolour coin).

The sensor 12 is operated at 400 KHz. The shift in frequency as the coin moves past the sensor is indicative of coin thickness and the shift in amplitude is indicative of the material of the outer skin of the central core of the coin.

The sensor 14 is operated at 20 KHz. The shifts in the frequency and amplitude of the sensor output as the coin passes are indicative of the material down to a significant depth within the core of the coin.

Figure 2:
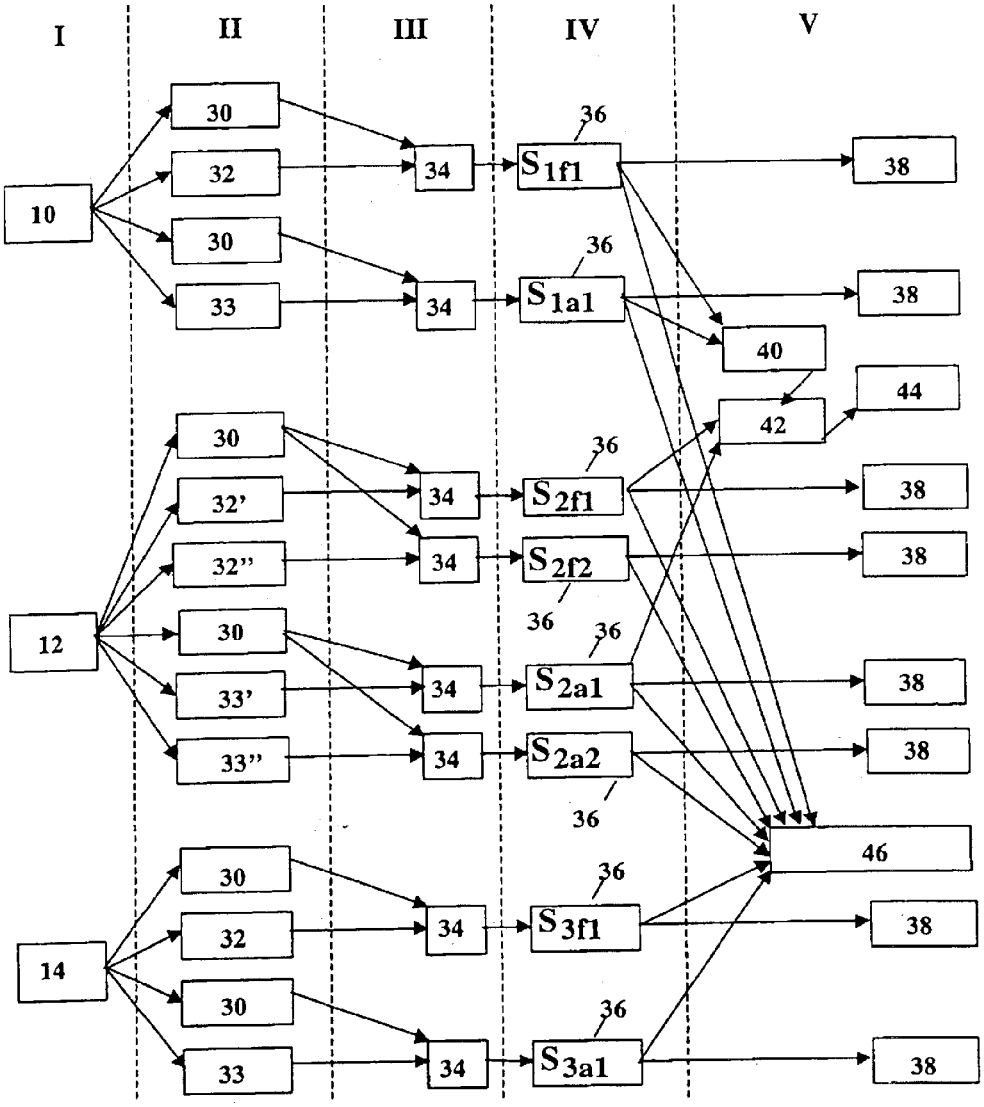
FIG. 2 is a diagram to illustrate the way in which sensor measurements are derived and processed.

FIG. 2 schematically illustrates the processing of the outputs of the sensors. The sensors 10, 12 and 14 are shown in section I of FIG. 2. The outputs are delivered to the interface circuit 16 which performs some preliminary processing of the outputs to derive digital values which are handled by the processor 18 as shown in sections II, III, IV and V of FIG. 2.

Within section II, the processor 18 stores the idle values of the frequency and the amplitude of each of the sensors, i.e. the values adopted by the sensors when there is no coin present. The procedure is indicated at blocks 30. The circuit also records the peak of the change in the frequency as indicated at 32, and the peak of the change in amplitude as indicated at 33. In the case of sensor 12, it is possible that both the frequency and the amplitude change, as the coin moves past, in a first direction to a first peak, and in a second direction to a negative peak (or trough) and again in the first direction, before returning to the idle value. Processor 18 is therefore arranged to record the value of the first frequency and amplitude peaks at 32' and 33' respectively, and the second (negative) frequency and amplitude peaks at 32" and 33" respectively.

At stage III, all the values recorded at stage H are applied to various algorithms at blocks 34. Each algorithm takes a peak value and the corresponding idle value to produce a normalised value, which is substantially independent of temperature variations. For example, the algorithm may be arranged to determine the ratio of the change in the parameter (amplitude or frequency) to the idle value. Additionally, or alternatively, at this stage III the processor 18 may be arranged to use calibration data which is derived during an initial calibration of the validator and which indicates the extent to which the sensor outputs of the validator depart from a predetermined or average validator. This calibration data can be used to compensate for validator-to-validator variations in the sensors.

At stage IV, the processor 18 stores the eight normalised sensor outputs as indicated at blocks 36. These are used by the processor 18 during the processing stage V which determines whether the measurements represent a genuine coin, and if so the denomination of that coin. The normalised outputs are represented as $S_{ijk}$ where:

i represents the sensor (1=sensor 10, 2=sensor 12 and 3=sensor 14), j represents the measured characteristic (f=frequency, a=amplitude) and k indicates which peak is represented (1=first peak, 2=second (negative) peak).

It is to be noted that although FIG. 2 sets out how the sensor outputs are obtained and processed, it does not indicate the sequence in which these operations are performed. In particular, it should be noted that some of the normalised sensor values obtained at stage IV will be derived before other normalised sensor values, and possibly even before the coin reaches some of the sensors. For example the normalised sensor values $S_{1f1}$, $S_{1a1}$ derived from the outputs of sensor 10 will be available before the normalised outputs $S_{2f1}$, $S_{2a1}$ derived from sensor 12, and possibly before the coin has reached sensor 12.

Referring to section V of FIG. 2, blocks 38 represent the comparison of the normalised sensor outputs with predetermined ranges associated with respective target denominations. This procedure of individually checking sensor outputs against respective ranges is conventional.

Block 40 indicates that the two normalised outputs of sensor 10, $S_{1f1}$ and $S_{1a1}$, are used to derive a value for each of the target denominations, each value indicating how close the sensor outputs are to the mean of a population of that target class. The value is derived by performing part of a Mahalanobis distance calculation.

In block 42, another two-parameter partial Mahalanobis calculation is performed, based on two of the normalised sensor outputs of the sensor 12, $S_{2f1}$, $S_{2a1}$ (representing the frequency and amplitude shift of the first peak in the sensor output).

At block 44, the normalised outputs used in the two partial Mahalanobis calculations performed in blocks 40 and 42 are combined with other data to determine how close the relationships between the outputs are to the expected mean of each target denomination. This further calculation takes into account expected correlations between each of the sensor outputs $S_{1f1}$, $S_{1a1}$ from sensor 10 with each of the two sensor outputs $S_{2f1}$, $S_{2a1}$ taken from sensor 12. This will be explained in further detail below.

At block 46, potentially all normalised sensor output values can be weighted and combined to give a single value which can be checked against respective thresholds for different target denominations. The weighting co-efficients, some of which may be zero, will be different for different target denominations.

The operation of the validator will now be described with reference to FIG. 3.

This procedure will employ an inverse co-variance matrix which represents the distribution of a population of coins of a target denomination, in terms of four parameters represented by the two measurements from the sensor 10 and the first two measurements from the sensor 12.

Thus, for each target denomination there is stored the data for forming an inverse co-variance matrix of the form:

$$M = \begin{matrix} \text{mat1, 1} & \text{mat1, 2} & \text{mat1, 3} & \text{mat1, 4} \\ \text{mat2, 1} & \text{mat2, 2} & \text{mat2, 3} & \text{mat2, 4} \\ \text{mat3, 1} & \text{mat3, 2} & \text{mat3, 3} & \text{mat3, 4} \\ \text{mat4, 1} & \text{mat4, 2} & \text{mat4, 3} & \text{mat4, 4} \end{matrix}$$

This is a symmetric matrix where mat x,y=mat y,x, etc. Accordingly, it is only necessary to store the following data:

$$\begin{matrix} \text{mat1, 1} & \text{mat1, 2} & \text{mat1, 3} & \text{mat1, 4} \\ & \text{mat2, 2} & \text{mat2, 3} & \text{mat2, 4} \\ & & \text{mat3, 3} & \text{mat3, 4} \\ & & & \text{mat4, 4} \end{matrix}$$

For each target denomination there is also stored, for each property m to be measured, a mean value $x_m$.

The procedure illustrated in FIG. 3 starts at step 300, when a coin is determined to have arrived at the testing section. The program proceeds to step 302, whereupon it waits until the normalised sensor outputs $S_{1f1}$ and $S_{1a1}$ from the sensor 10 are available. Then, at step 304, a first set of calculations is performed. The operation at step 304 commences before any normalised sensor outputs are available from sensor 12.

At step 304, in order to calculate a first set of values, for each target class the following partial Mahalanobis calculation is performed:

$$D1 = \text{mat1,1}\cdot\partial1\cdot\partial1 + \text{mat2,2}\cdot\partial2\cdot\partial2 + 2\cdot(\text{mat1,2}\cdot\partial1\cdot\partial2)$$

where $\partial1 = S_{1f1} - x_1$ and $\partial2 = S_{1a1} - x_2$, and $x_1$ and $x_2$ are the stored means for the measurements $S_{1f}$ and $S_{1a1}$ for that target class.

The resulting value is compared with a threshold for each target denomination. If the value exceeds the threshold, then at step 306 that target denomination is disregarded for the rest of the processing operations shown in FIG. 3.

It will be noted that this partial Mahalanobis distance calculation uses only the four terms in the top left section of the inverse co-variance matrix M.

Following step 306, the program checks at step 308 to determine whether there are any remaining target classes following elimination at step 306. If not, the coin is rejected at step 310.

Otherwise, the program proceeds to step 312, to wait for the first two normalised outputs $S_{2f1}$ and $S_{2a1}$ from the sensor 12 to be available.

Then, at step 314, the program performs, for each remaining target denomination, a second partial Mahalanobis distance calculation as follows:

$$D2 = \text{mat3,3}\cdot\partial3\cdot\partial3 + \text{mat4,4}\cdot\partial4\cdot\partial4 + 2\cdot(\text{mat3,4}\cdot\partial3\cdot\partial4)$$

where $\partial3 = S_{2f1} - x_3$ and $\partial4 = S_{2a1} - x_4$, and $x_3$ and $x_4$ are the stored means for the measurements $S_{2f1}$ and $S_{2a1}$ for that target class.

This calculation therefore uses the four parameters in the bottom right of the inverse co-variance matrix M.

Then, at step 316, the calculated values D2 are compared with respective thresholds for each of the target denominations and if the threshold is exceeded that target denomination is eliminated. Instead of comparing D2 to the threshold, the program may instead compare (D1+D2) with appropriate thresholds.

Assuming that there are still some remaining target denominations, as checked at step 318, the program proceeds to step 320. Here, the program performs a further calculation using the elements of the inverse co-variance matrix M which have not yet been used, i.e. the cross-terms principally representing expected correlations between each of the two outputs from sensor 10 with each of the two outputs from sensor 12. The further calculation derives a value DX for each remaining target denomination as follows:

$$DX = 2\cdot(\text{mat1,3}\cdot\partial1\cdot\partial3 + \text{mat1,4}\cdot\partial1\cdot\partial4 + \text{mat2,3}\cdot\partial2\cdot\partial3 + \text{mat2,4}\cdot\partial2\cdot\partial4)$$

Then, at step 322, the program compares a value dependent on DX with respective thresholds for each remaining target denomination and eliminates that target denomination if the threshold is exceeded. The value used for comparison may be DX (in which case it could be positive or negative). Preferably however the value is D1+D2+DX. The latter sum represents a full four-parameter Mahalanobis distance taking into account all cross-correlations between the four parameters being measured.

At step 326 the program determines whether there are any remaining target denominations, and if so proceeds to step 328. Here, for each target denomination, the program calculates a value DP as follows:

$$DP = \sum_{n=1}^{8} \partial_n \cdot a_n$$

where $\partial_1 \ldots \partial_8$ represent the eight normalised measurements $S_{i,j,k}$ and $a_1 \ldots a_8$ are stored coefficients for the target denomination. The values DP are then at step 330 compared with respective ranges for each remaining target class and any remaining target classes are eliminated depending upon whether or not the value falls within the respective range. At step 334, it is determined whether there is only one remaining target denomination. If so, the coin is accepted at step 336. The accept gate is opened and various routing gates are controlled in order to direct the coin to an appropriate destination. Otherwise, the program proceeds to step 310 to reject the coin. The step 310 is also reached if all target denominations are found to have been eliminated at step 308, 318 or 326.

The procedure explained above does not take into account the comparison of the individual normalised measurements with respective window ranges at blocks 38 in FIG. 2. The procedure shown in FIG. 3 can be modified to include these steps at any appropriate time, in order to eliminate further the number of target denominations considered in the succeeding stages. There could be several such stages at different points within the program illustrated in FIG. 3, each for checking different measurements. Alternatively, the individual comparisons could be used as a final boundary check to make sure that the measurement of a coin about to be accepted fall within expected ranges. As a further alternative, these individual comparisons could be omitted.

In a modified embodiment, at step 314 the program selectively uses either the measurements $S_{2f1}$ and $S_{2a1}$ (representing the first peak from the second sensor) or the measurements $S_{2f2}$ and $S_{2a2}$ (representing the second peak from the second sensor), depending upon the target class.

There are a number of advantages to performing the Mahalanobis distance calculations in the manner set out above. It will be noted that the number of calculations performed at stages 304, 314 and 320 progressively decreases as the number of target denominations is reduced. Therefore, the overall number of calculations performed as compared with a system in which a full four-parameter Mahalanobis distance calculation is carried out for all target denominations is substantially reduced, without affecting discrimination performance. Furthermore, the first calculation at step 304 can be commenced before all the relevant measurements have been made.

The sequence can however be varied in different ways. For example, steps 314 and 320 could be interchanged, so that the cross-terms are considered before the partial Mahalanobis distance calculations for measurements $\partial 3(=S_{2f1}-x_3)$ and $\partial 4(=S_{2a1}-x_4)$ are performed. However, the sequence described with reference to FIG. 3 is preferred because the calculated values for measurements $\partial 3$ and $\partial 4$ are likely to eliminate more target classes than the cross-terms.

In the arrangement described above, all the target classes relate to articles which the validator is intended to accept. It would be possible additionally to have target classes which relate to known types of counterfeit articles. In this case, the procedure described above would be modified such that, at step 334, the processor 18 would determine (a) whether there is only one remaining target class, and if so (b) whether this target class relates to an acceptable denomination. The program would proceed to step 336 to accept the coin only if both of these tests are passed; otherwise, the coin will be rejected at step 310.

Other distance calculations can be used instead of Mahalanobis distance calculations, such as Euclidean distance calculations.

The acceptance data, including for example the means $x_m$ and the elements of the matrix M, can be derived in a number of ways. Preferably, the data is derived using a separate apparatus (which may be a validator or at least a sensor set) of very similar construction, or a number of such apparatuses, in which case the measurements from each apparatus can be processed statistically to derive a nominal average mechanism. Analysis of the data will then produce the appropriate acceptance data for storing in production validators.

Due to manufacturing tolerances, the production validators will behave differently. To deal with this, a calibration operation is performed. This derives calibration data which can be used to modify or supplement the acceptance data for each mechanism. Alternatively, the sensor outputs could be adjusted according to the calibration data.

As a further alternative, the initial acceptance data could be derived by a calibration operation involving feeding a population of each of the target classes into the apparatus and reading the measurements from the sensors.

In any event, calibration of the apparatus involves causing the apparatus to test articles of known classes and deriving calibration data from the measurements. This procedure can be carried out in the factory where the apparatus is manufactured, or in the field, for example after a repair or upgrading operation requires re-calibration.

The calibration procedure preferably uses external equipment which extracts the measurements from the currency acceptor and processes it with generic classification data which is also used for calibrating other acceptors, and which derives the calibration data and transmits it for storage in the acceptor. The external apparatus may be a general purpose computer, or may be a dedicated and preferably portable terminal, which is particularly useful if the mechanism is to be re-calibrated in the field.

Figure 4:
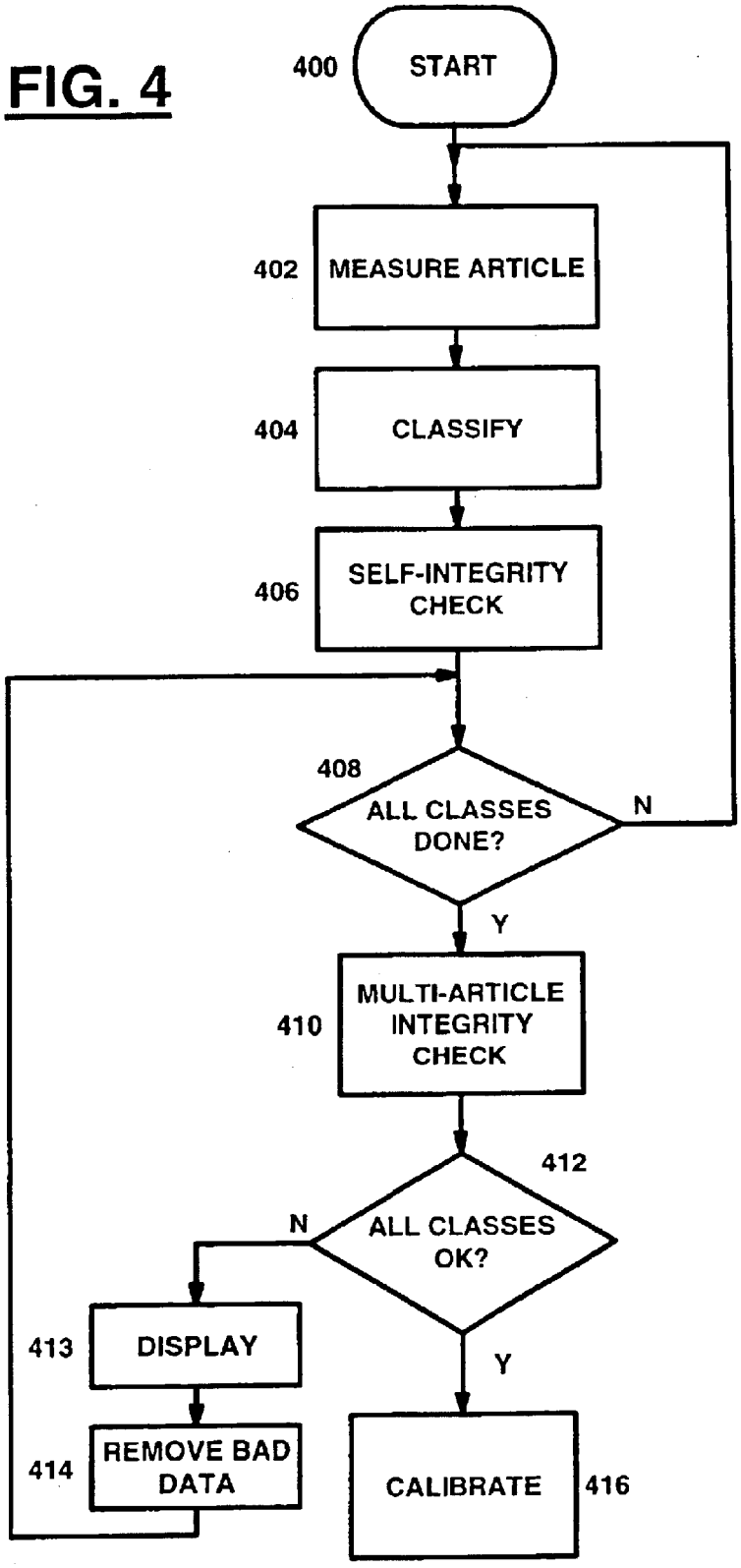
FIG. 4 is a flow chart showing a procedure for calibrating the validator.

The calibration procedure will be described with reference to FIG. 4. The procedure starts at step 400.

Step 402 represents the insertion and measurement of an article. This article belongs to one of a number of known calibration classes, although the specific class to which it belongs is not necessarily known. It is to be noted that the articles used for calibration purposes may or may not belong to the classes which the calibrated apparatus is configured to recognise. Generally, there will be at least one, and usually more, target classes which can be recognised by the calibrated apparatus but which are not included in the calibration classes. The present invention is particularly applicable to arrangements, such as that described above, wherein calibration data derived from measurements of calibration classes is used for calibration of the apparatus as a whole, rather than merely calibrating acceptance tests for specific target classes, e.g. target classes which correspond to calibration classes.

At step 404, the measurements of the article are used to classify the article. This is preferably done by using data representing correlations between the measurements in populations of respective calibration classes. Preferably, for each calibration class there is stored data representing an inverse co-variance matrix to enable the article measurements to be processed with the matrix in order to derive a Mahalanobis distance representing the similarity of the measured article to the mean of the population of the respective calibration class. The calculation of the Mahalanobis distance may therefore be similar to the operations performed by the apparatus during its use in the field for classification of received articles. However, during the calibration process, there are fewer restrictions upon data storage capacity, processing power and the time permitted to perform the calculations. Accordingly, during calibration, preferably a greater number and possibly all of the measurements are used to derive the Mahalanobis distance.

A further difference is that, during the calibration procedure, the measured articles are assumed to belong to a specific set of known calibration classes. The classification procedure at step 404 therefore allocates each article to the calibration class associated with the smallest Mahalanobis distance.

A still further difference in the calibration procedure is that the classification has to be performed with an uncalibrated mechanism. Accordingly, the measurements produced by the sensors in response to a given article cannot be accurately predicted. To some extent, this problem is mitigated by using measurement correlations for classification purposes. However, in accordance with a further preferred feature of the invention, a normalisation procedure is adopted to reduce the effect of acceptor-to-acceptor variations and thus enhance the reliability of the classification procedure.

According to this preferred aspect, at least some, and preferably all, of the measurements used to calculate the Mahalanobis distance are first normalised with reference to one or more other measurements. For example, seven of the measurements may each be divided by the eighth measurement, the resulting seven values being used to calculate a Mahalanobis distance using data representing correlations between corresponding measurement ratios in a population of the relevant calibration class. The selection of the measurement used as a normalisation factor may vary according to the calibration class for which the Mahalanobis distance is being calculated.

After the classification operation at step 404, the calibration procedure involves a self-integrity check at step 406. At this step, the minimum calculated Mahalanobis distance, which determines the classification of the article, is compared with a threshold (which may vary according to the calibration class). If the distance exceeds the threshold, this indicates that the article has given non-representative results, for example because it is a "flyer", and the article fails the self-integrity check. Thus, the self-integrity test involves checking that the different measurements of an article bear a predetermined relationship with each other.

At step 406, if the self-integrity check is passed, then the calibration program stores a flag indicating that an article of the relevant class has been properly measured.

At step 408, the program determines whether articles of all calibration classes have been properly measured. If not, steps 402, 404 and 406 are repeated until articles of all relevant classes have been measured.

It will be understood from the foregoing that there is no requirement to calibrate by feeding in known articles in a particular sequence. The calibration articles can be fed in in any desired sequence, or a random sequence. Preferably, the calibration operation requires only a single article of each calibration class to be measured only once. However, if more than one article of the same class is measured, then preferably the measurements are combined, e.g. by averaging, so as to make use of the additional data.

Figure 5:
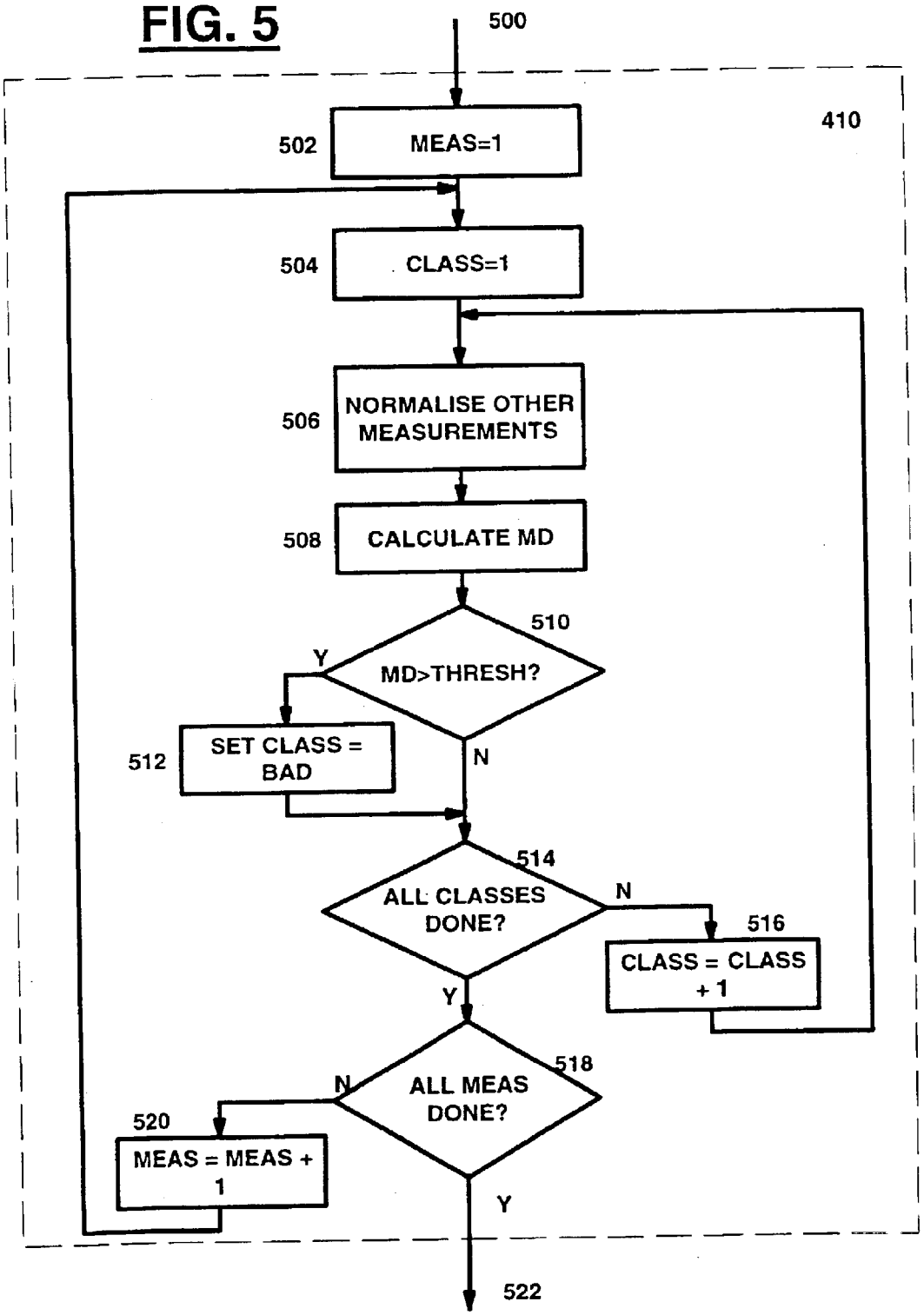
FIG. 5 is a flow chart showing an integrity-checking operation in the calibration procedure.

At step 410, the program performs a multi-article integrity check which is described in more detail below with reference to FIG. 5. As a result of this check, it is possible that the measurements relating to one or more of the calibration articles may be deemed unreliable, in which case the relevant flag for the calibration class is cleared to indicate that further measurements of an article of this class are required.

At step 412, the program checks the flags to determine whether sufficient measurements have been made, i.e. whether at least one article of each calibration class has been reliably measured. If so, the program proceeds to step 413, in which an appropriate display is provided to an operator, and then to step 414, in which the stored measurements which have been found to be unreliable are removed. The program then loops back to step 408.

Preferably, at step 413 the calibration apparatus displays data identifying those calibration classes for which the measurements have been deemed unreliable at step 410, so that the operator performing the calibration only needs to re-insert the relevant articles. However, in some circumstances it may be easier to re-insert articles of all the calibration classes, especially if this is a relatively small number of articles. For example, a hopper may be used to feed a single article of each calibration class to the currency acceptor, so that the articles are simply placed in the hopper to perform the calibration. Then, after all articles have been measured, if the calibration apparatus reports that more measurements are required, all the articles can again be placed in the hopper.

This procedure continues until, at step 412, it is determined that reliable measurements have been made of articles of all the calibration classes. The program then proceeds to step 416, in which the measurements are used to derive calibration data.

As indicated above, the calibration data can be used in any of a number of per se known ways. For example, the calibration data can be used to derive appropriate window limits as used in blocks 38 of the processing operation of FIG. 2, or to adjust the means $x_m$ used in the Mahalanobis distance calculations of the acceptance procedure. Alternatively, the calibration data can be used to adjust the sensor measurements at stage III of FIG. 2.

The multi-article integrity check of step 410 will now be described with reference to FIG. 5.

The procedure starts as indicated at 500. At step 502, a pointer MEAS is set to indicate a first of the measurements made of the different articles.

At step 504, a pointer CLASS is set to indicate a first of the calibration classes.

At step 506, the measurements indicated by pointer MEAS for all articles, other than the article of class CLASS, are normalised by dividing them by the measurement MEAS for the article of class CLASS.

At step 508, the measurement ratios are used to calculate a Mahalanobis distance MD, based on stored data representing correlations between these ratios in populations of the calibration classes.

At step 510, the Mahalanobis distance MD is compared with a threshold. If the threshold is exceeded, the program proceeds to step 512. This is likely to be reached if the article of class CLASS has given unrepresentative measurements. Accordingly, at step 512, a flag is set to indicate that the measurements for the article of class CLASS are unreliable.

Following step 510 or 512, the program proceeds to step 514 to check whether all the calibration classes have been used for normalisation purposes. If not, the pointer CLASS is incremented at step 516, and the program loops back to step 506. This is repeated until all calibration classes have been used for normalising.

Then, at step 518, the program checks that all the different types of measurements have been processed in this way. If not, the program proceeds to step 520 to increment the pointer MEAS, and then the program loops back to step 504.

After all the types of measurements have been processed, the multi-article integrity check 410 terminates as indicated at 522.

In the preferred embodiment the program is operable to determine whether the checks performed at steps 406 and/or

510 indicate that inappropriate values are being consistently produced by one or more of the sensors, and in response thereto to cause, at step 413, a display indicating a possible fault in the or each such sensor. For example, such a display could be produced if step 512 is frequently reached when the pointer MEAS, representing the type of measurement used for normalisation, has a particular value, indicating that measurements of this type are frequently inappropriate.

Various modifications are possible. For example, the normalisation of each measurement used in the Mahalanobis calculations could be achieved by taking the ratio of that measurement and the other measurement selected as the normalisation factor, or the differences between these measurements, or the difference between the ratio and a stored mean of the ratio based on measured populations. The validator may be capable of a self-tuning operation, in which case, after the calibration operation, the acceptance criteria could be initially refined by using the self-tuning feature, preferably carried out under the control of an operator using known articles, the operation preferably being designed to result in significantly tighter acceptance criteria before the validator is left for use in the field.

What is claimed is:

1. A method of calibrating apparatus for validating currency articles, the method comprising causing the apparatus to measure each of a plurality of articles of different respective known calibration classes in order to derive a plurality of different measurements of the article, determining from the measurements which of the known calibration classes each of the respective articles belongs to using classification criteria which are all used in common for different apparatuses, and deriving calibration data from the measurements and the determinations of the classes, the calibration data then being usable by the apparatus to determine which of a plurality of target classes further measured articles belong to.

2. A method as claimed in claim 1, wherein the class of each article measured in the calibration operation is determined by processing the measurements of the article with stored data representing correlations between the measurements in a population of articles of the respective class.

3. A method as claimed in claim 2, including normalising a plurality of the different measurements of each article using at least one other measurement of the article as a normalisation factor, and classifying the article on the basis of its normalised measurements.

4. A method as claimed in claim 2, including the step of inhibiting the use of measurements of an article for calibration in dependence on the how closely the relationships between the measurements resemble an expected correlation.

5. A method as claimed in claim 1, wherein the apparatus is calibrated by measuring only once a single article of each class.

6. A method as claimed in claim 1, wherein said determining step and said step of deriving calibration data is performed by calibration apparatus external of said validating apparatus.

7. A method as claimed in claim 1, wherein said target classes include at least one class which is not one of said calibration classes.

8. A method as claimed in claim 1, wherein the calibration data is used adjust sensor measurements of articles prior to using the adjusted measurements for classification of the articles.

9. A method of calibrating apparatus for validating articles of currency, the method comprising causing the apparatus to take measurements of articles of different calibration classes, and deriving from those measurements calibration data for use by the apparatus to determine whether a measured article belongs to a predetermined class, the method further comprising performing an integrity check on the measurements by comparing measurements of articles of different classes with each other, and inhibiting the use of at least some measurements for calibration in dependence on the result of the integrity check.

10. A method as claimed in claim 9, wherein the integrity check involves the use of stored data representing correlations between measurements of articles of different classes within populations of those classes.

11. A method as claimed in claim 10, wherein the integrity step involves normalising measurements of articles of a plurality of classes using a corresponding measurement of an article of a further class as a normalisation factor, and comparing the normalised measurements.

12. A method as claimed in claim 11, wherein the integrity check comprises repeatedly comparing normalised measurements each time using a measurements of an article of a respective different further class for the normalisation factor.

13. A method as claimed in claim 9, wherein a plurality of different measurements are taken of each article, the method including the step of repeating the integrity check for the different types of measurements.

14. A method as claimed in claim 9, including the step of indicating the classes of the articles whose measurements are inhibited from being used for calibration.

15. A method as claimed in claim 9, including the step of performing a separate integrity check for each article, the separate integrity check comprising investigating the relationships between different measurements of the article and inhibiting the use of measurements for calibration in dependence on the result of the separate integrity check.

16. A method of calibrating apparatus for validating articles of currency, the method comprising causing the apparatus to take respective different measurements of an article, and deriving from those measurements calibration data for use by the apparatus to determine whether a measured article belongs to a predetermined class, the method further comprising performing an integrity check on the measurements by determining whether the relationship between them satisfies a predetermined criterion and inhibiting the use of at least some measurements for use in calibrating in dependence on the result of the integrity check.

17. A method as claimed in claim 16, wherein the integrity check involves the use of stored data representing correlations between different measurements of articles of a class within a population of that class.

18. A method claimed in claim 16 or claim 17, including normalising a plurality of different measurements of each article using at least one other measurement of the article as a normalisation factor, and performing the integrity check on the basis of the normalised measurements.

19. A method as claim 16, including the step of providing an indication that an article should be re-measured in response to failure of the integrity check.

20. Apparatus arranged to perform a method as claimed in claims 1, 9 or 16.

* * * * *